United States Patent [19]

Turner et al.

[11] 3,984,636

[45] Oct. 5, 1976

[54] QUADRAPHONIC HEADPHONE WITH AMBIENCE PROGRAMMER

[75] Inventors: Jacob C. Turner; Douglas M. Elliott, both of Milwaukee, Wis.

[73] Assignee: Koss Corporation, Milwaukee, Wis.

[22] Filed: Mar. 6, 1975

[21] Appl. No.: 556,144

[52] U.S. Cl. ..... 179/1 GQ; 179/156 R

[51] Int. Cl.[2] ..... H04R 5/00

[58] Field of Search ..... 179/1 GQ, 1 GA, 1 G, 179/1 B, 1 PC, 100.1 TD, 100.4 ST, 156 R

[56] References Cited

UNITED STATES PATENTS

| | | | |
|---|---|---|---|
| 3,592,978 | 7/1971 | Hess | 179/156 R |
| 3,609,240 | 9/1971 | Fixler | 179/1 G |
| 3,794,779 | 2/1974 | Greuzerd et al. | 179/1 GQ |
| 3,796,840 | 3/1974 | Ohta | 179/1 GQ |
| 3,830,978 | 8/1974 | Odagi | 179/1 GQ |
| 3,863,028 | 1/1975 | Fixler | 179/1 GQ |
| 3,883,692 | 5/1975 | Tsurushima | 179/1 GQ |
| 3,900,707 | 8/1975 | Hanson | 179/156 R |

*Primary Examiner*—Douglas W. Olms
*Attorney, Agent, or Firm*—Quarles & Brady

[57] ABSTRACT

A quadraphonic headphone including an ambience control circuit which is contained within a hand sized case which is connected to the audio transducers in each headphone cup and which may be connected to a source of quadraphonic program material. The control circuit includes switches that allow the user to select the desired cross coupling of phase shifted audio signals between left and right primary audio transducers and left and right secondary audio tranducers, allows him to reverse the connections to any one of the audio transducers and allows him to sum the signals applied to the left or right audio transducers. The effect of this electronic mixing is enhanced by asymmetrically mounted the audio transducers within each headphone cup.

11 Claims, 6 Drawing Figures

Fig. 1
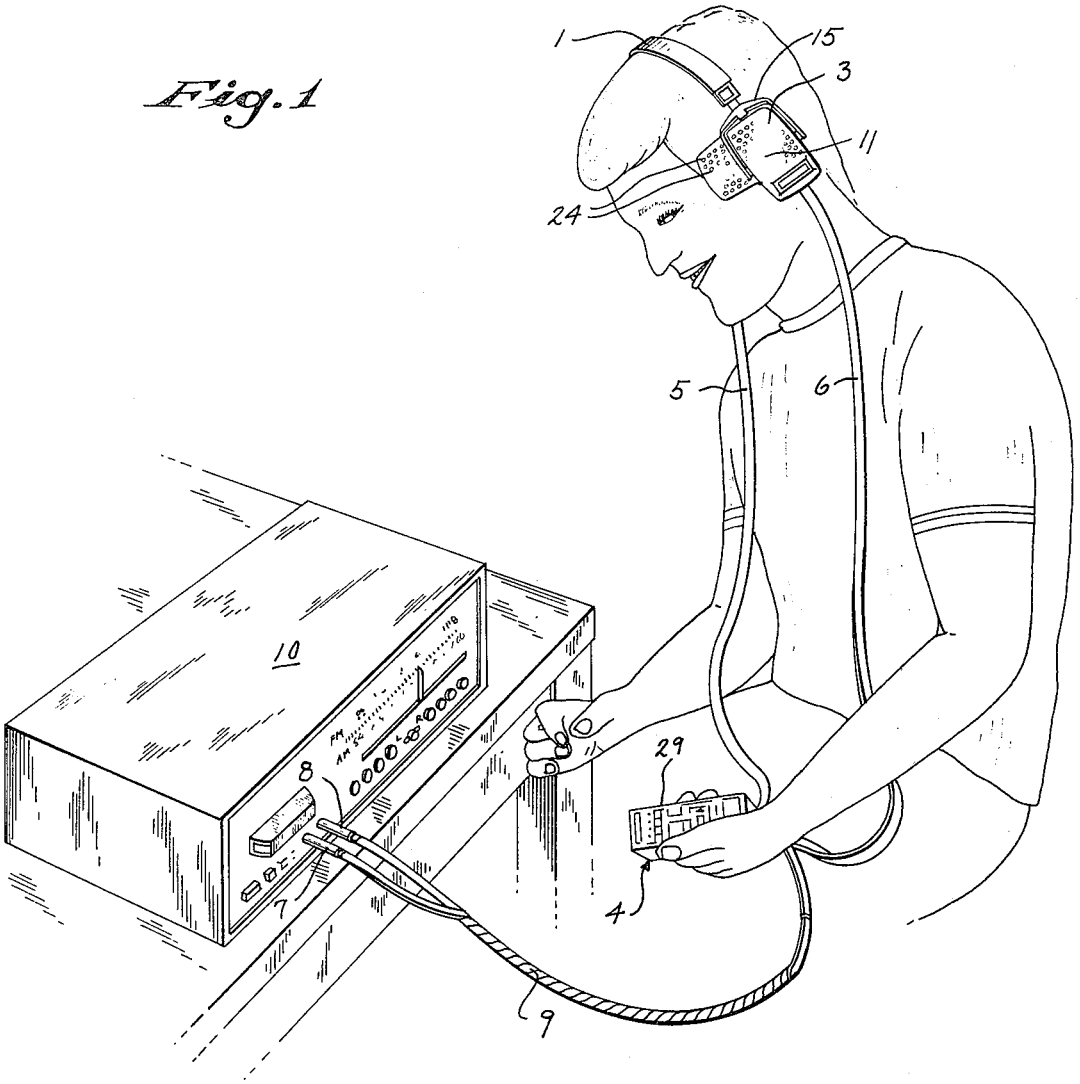
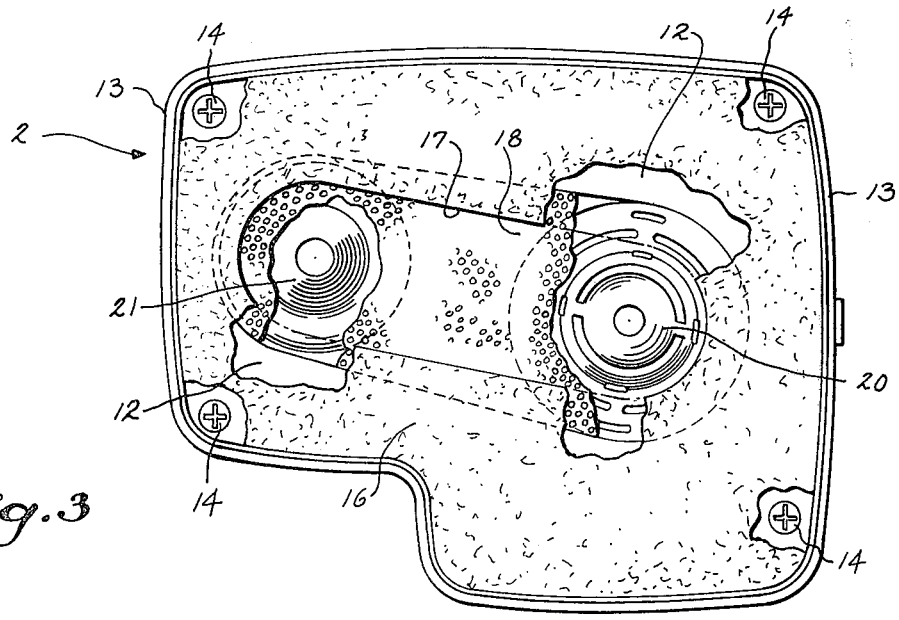
Fig. 3

Fig. 4
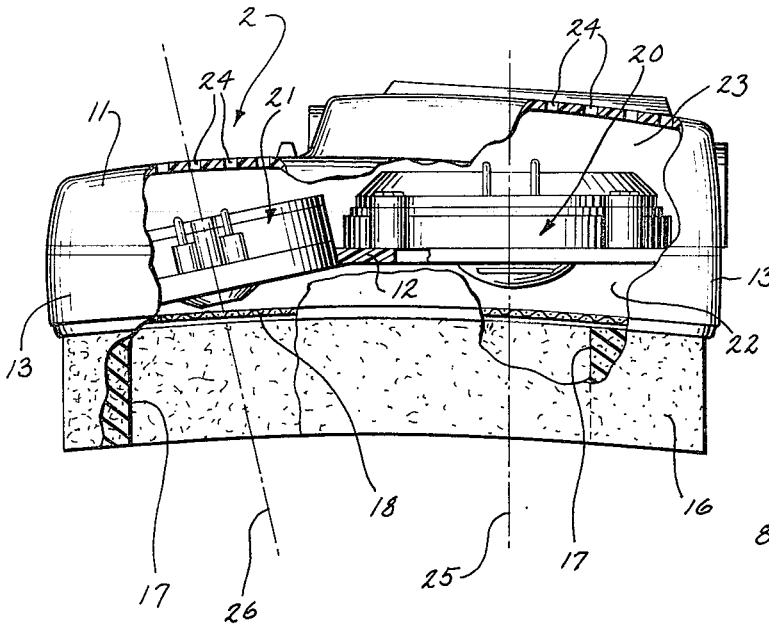
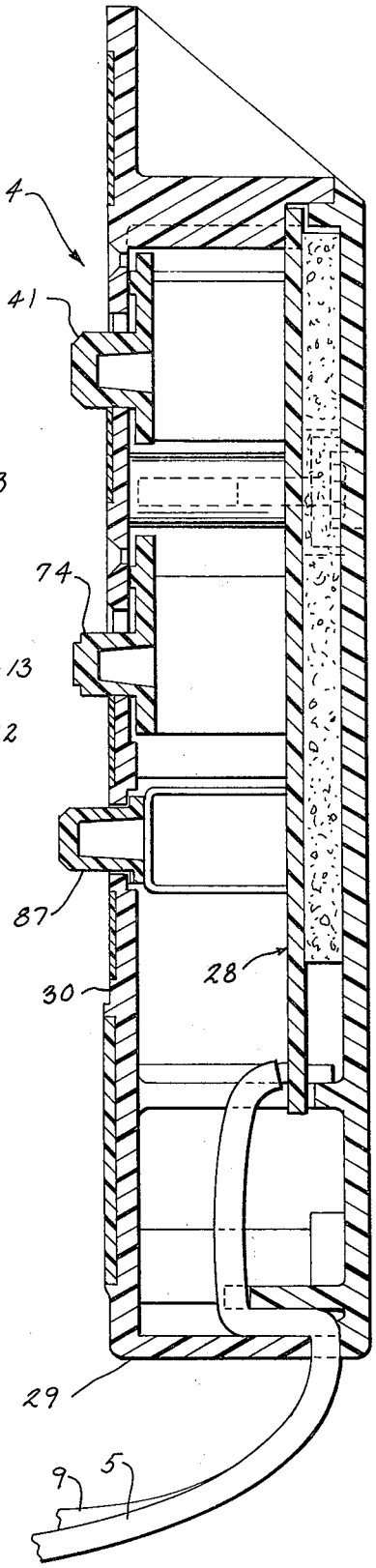
Fig. 6

QUADRAPHONIC HEADPHONE WITH AMBIENCE PROGRAMMER

BACKGROUND OF THE INVENTION

The field of the invention is headphones, and more particularly, high fidelity headphones for reproducing quadraphonically recorded program material.

As indicated in copending U.S. Pat. No. 3,924,072 issued on Dec. 2, 1975 and entitled "Headphone With Ambience Control", commercially available recordings include separate channels of program information which are formed by combining signals from microphones disposed throughout the recording studio. Stereophonic recordings are formed by combining these signals into two channels and quadraphonic recordings are formed by combining them into four channels. When reproduced by loudspeakers, recorded quadraphonic program material reaches both ears of the listener to not only provide directionally, but also to provide a natural mixing of the channels. This mixing is not merely the addition of a portion of one channel to the others, but is instead, a complex addition of phase shifted sounds which varies depending upon the position of the listener in the room, the orientation of his head, the frequency of the program material and size, shape and contents of the room.

Such mixing does not occur when the recorded program material is reproduced through headphones. The program material is instead coupled directly to the left or right ear of the listener, and as a result, apparent gaps between discrete sound sources may occur rather than a continuous "panorama" of sound. In the above cited patent, a means for overcoming this effect in stereophonic headphones is disclosed in which a portion of the signal from each channel is electrically phase shifted and applied to the transducer of the other channel.

There are a number of commercially available quadraphonic headphones, all of which include four audio transducers that are each connected to receive one of the four quadraphonic channels. Two of the transducers are mounted in each headphone cup, with the left front and left back channels being applied directly to the listener's left ear and the right front and right back channels being applied to his right ear. Typically, no mixing occurs between the left and right channels, whereas nearly total mixing occurs between the front and back channels on each side. The resulting effect is substantially different from that obtained by listening to the same quadraphonic program material through a loudspeaker system where "natural" mixing of the four channels ocurs before reaching the ears of the listener.

SUMMARY OF THE INVENTION

The present invention relates to a headphone for reproducing quadraphonic program material in which programmable electronic mixing of the four quadraphonic channels is provided to simulate various natural listening conditions. More specifically, the invention resides in a headphone having a pair of cups connected together by a headband, a primary and a secondary audio transducer mounted in each cup with the sound emitting axis of each primary audio transducer positioned directly over the ear canal of the listener and with the sound emitting axis of the secondary transducer positioned substantially forward of the listener's ear canal, and means for coupling the primary audio transducers to receive the front channel program material and for coupling the secondary audio transducers to receive the back channel program material. This asymmetrical mounting of the audio transducers in each cup provides a phase shift in the back channel program material which simulates the natural mixing between front and back channels that occurs with a loudspeaker system.

The invention further resides in an ambience programmer which couples the quadraphonic program material to the four audio transducers and which provides selectable, electronic mixing of the four channels to simulate the natural mixing which occurs when the program material is reproduced through loudspeaker. The ambience programmer is contained within a hand sized case and includes switches that allow the listener to selectively mix phase shifted portions of the audio channels with one another. The effect of this electronic mixing of the program material is enhanced by the preset phase shift provided by the asymmetrically mounted audio transducers in each cup.

It is a general object of the invention to simulate natural quadraphonic listening with quadraphonic headphones. The ambience programmer allows the listener to selectively mix the audio channels to simulate any one of a number of listening conditions.

A specific object of the invention is to reproduce quadraphonic program material with fidelity. The paths between the primary and secondary transducers and the ears of the listener are direct and unobstructed. The secondary audio transducers which reproduce the back channel program material are positioned forward of the listener's ears where the auricle does not obstruct or interfere with the sound.

Still another more specific object of the invention is to minimize the weight of the headphone. The ambience programmer circuit is contained in a separate case which can be inserted in a shirt pocket when not being programed by the user.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention and reference is made to the claims herein.

BRIEF DESCRIPTION OF THE DRAWINGS

FIG. 1 is a pictorial view of the quadraphonic headphones of the present invention in use, FIG. 3 is a side view of the quadraphonic headphone with parts cut away to show the audio transducers therein, FIG. 4 is a top view with parts cut away of the headphone cup of FIG. 3, FIG. 6 is a view in cross section of the ambience programmer taken along the plane 6—6 of FIG. 2.

DESCRIPTION OF THE PREFERRED EMBODIMENT

Figure 2:
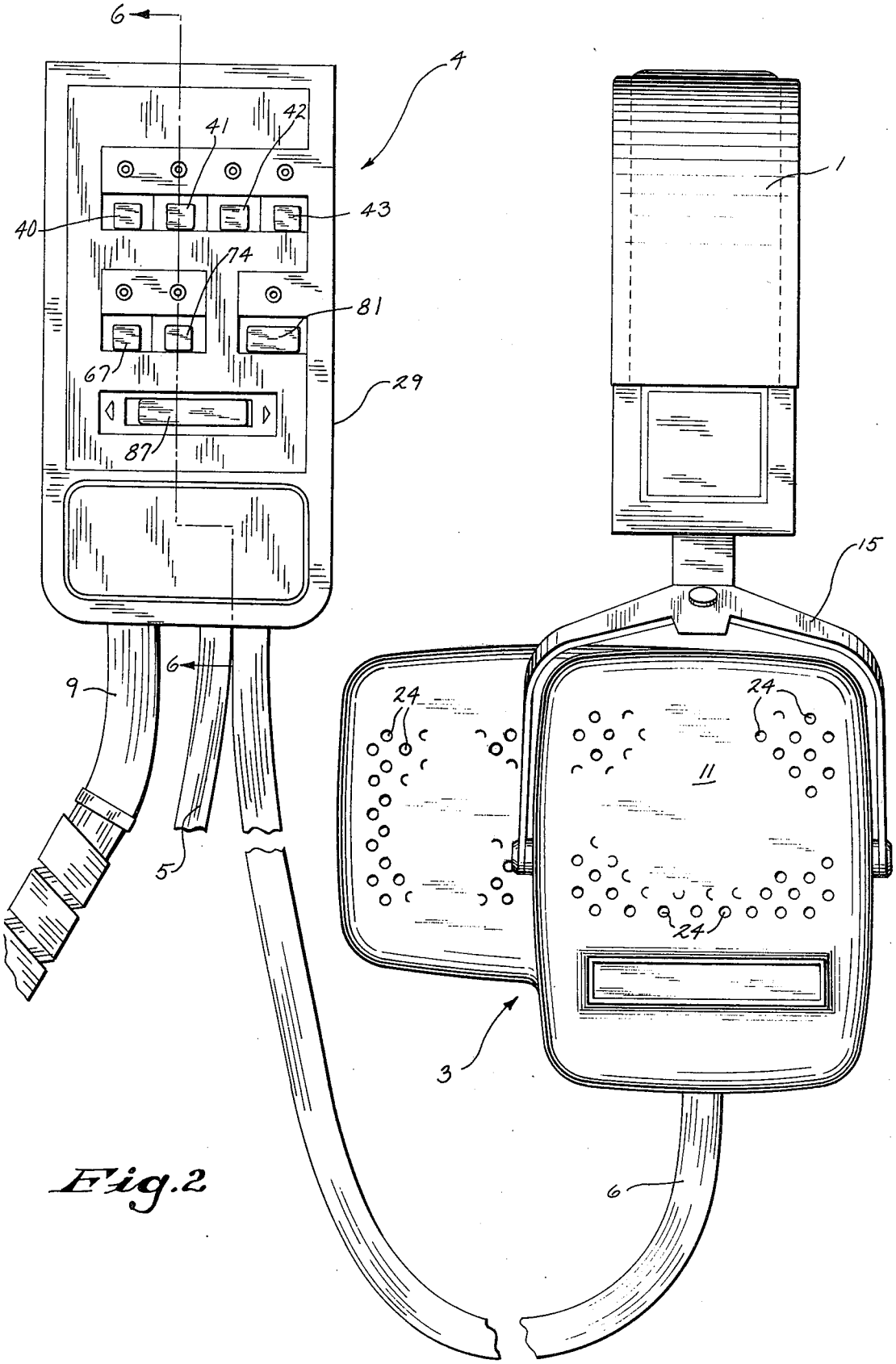
FIG. 2 is a side view of the quadraphonic headphone of FIG. 1 along with a front view of its associated ambience programmer.

Referring particularly to FIG. 1, the invention is embodied in a quadraphonic headphone which includes a headband 1 that extends over the listener's head and provides support for a right cup 2 and left cup 3. The cups 2 and 3 are connected to an ambience programmer 4 by respective cables 5 and 6 and the ambience programmer 4 is in turn connected to a pair of phone jacks 7 and 8 by a cable 9. The phone jacks 7 and 8 connect to receptacles on a source of quadraphonic program material as represented by the amplifier 10.

Referring particularly to FIGS. 2, 3 and 4, each cup includes a back 11 which is molded from a plastic and which connects with a baffle 12 that is also molded from a plastic. The baffle 12 includes an integrally molded flange portion 13 which extends around its perimeter and mates with the forward edge of the back 11. A set of four screws 14 securely fasten the baffle 12 to the back 11 and the entire assembly is rotatably fastened to a metallic yoke 15 which connects it to one end of the headband 1. A cushion 16 made from a reticulated sponge material is bonded to the front surface of the baffle 12 and it includes an elongated sound opening 17 which extends in a substantially front-to-rear direction. The cushion 16 conforms to the head of the user and provides a comfortable fit when the headphones are in place.

Mounted to the baffle 12 in each cup 2 and 3 is a primary audio transducer 20 and a secondary audio transducer 21. The baffle 12 divides the cup into a first chamber 22 which is defined in part by the flange portion 13, and a second chamber 23 which is defined by the molded back 11. The second chamber 23 is vented to atmosphere by openings 24 formed in the back 11 and the first chamber 22 is coupled to the ear canal of the listener through the sound opening 17 in the cushion 16. The audio transducers 20 and 21 direct sound through the elongated sound opening 17 to the listener's ear and are protected by a screen 18 which is held between the front surface of the baffle 12 and the rear surface of the cushion 16.

The primary audio transducer 20 is mounted toward the rear of the cup with its sound emitting axis 25 positioned directly over the listener's ear canal. On the other hand, the secondary audio transducer 21 is mounted toward the forward end of the cup with its sound emitting axis 26 substantially forward of the listener's ear. As a result, the sound emitted by the primary audio transducer 20 travels a relatively short distance directly to the listener's ear canal whereas the sound emitted by the secondary audio transducer 21 has a substantially longer distance to travel. This asymmetrical mounting of the audio transducers 20 and 21 in each cup 2 and 3 introduces a fixed time delay into the sound reaching the listener's ears from the secondary audio transducers, and this in turn introduces a phase shift therein. The secondary audio transducers 21 are located forward of the listener's ears rather than to the rear and although the secondary audio transducers 21 are connected to receive the back channel audio signals, their forward disposition is preferable because in this position the sound path is not obstructed by the auricle of the listener's ear. Because visual and tactile senses are not involved when listening to quadraphonic sound through headphones, the listener is unaware that the back channels are being reproduced by forwardly located audio transducers.

Referring particularly to FIGS. 2 and 6, the audio transducers 20 and 21 in each cup 2 and 3 are electrically connected to the ambience programmer 4 through the cables 5 and 6. The ambience programmer 4 includes a circuit board 28 which is enclosed in a two-part, rectangular case 29 which is formed of a molded plastic. The components of the ambience control circuit which are to be decribed in more detail below are mounted on the circuit board 28 and the leads in the cables 5 and 6 from the cups 2 and 3 as well as the leads in the cable 9 from the quadraphonic amplifier 10 are affixed thereto. Electrical switches which form a part of this control circuit extend through openings in a front wall 30 of the case 29 where they can be easily operated by the listener. The ambience programmer can be held in the palm of the hand or inserted in a shirt pocket when not in use.

Figure 5:
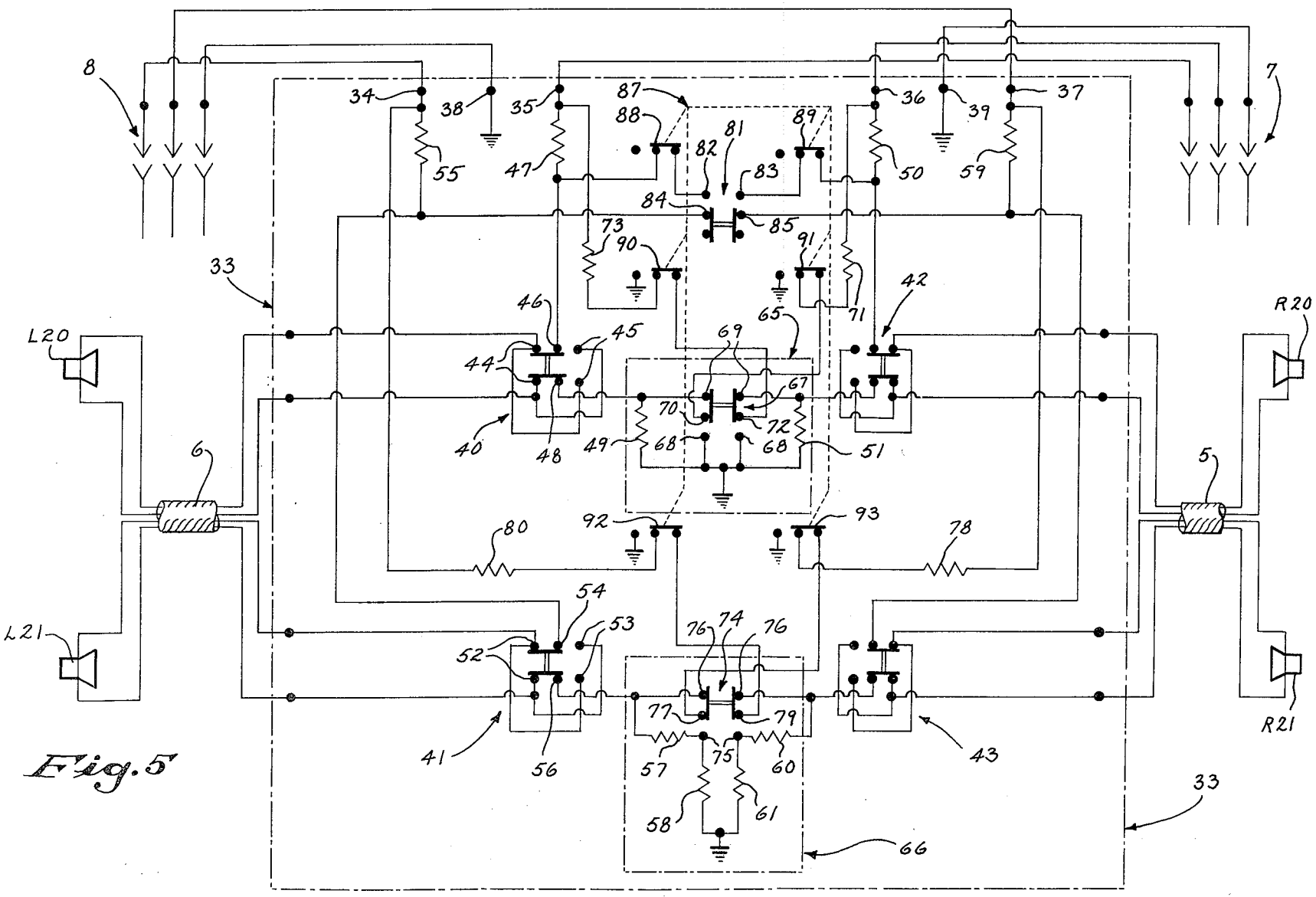
FIG. 5 is an electrical schematic diagram of the ambience programmer and attached audio transducers.

Referring particularly to FIG. 5, the ambience control circuit mounted within the ambience programmer 4 is illustrated schematically within the dashed line 33. Hereinafter, the audio transducers in the left headphone cup 3 are identified as L20 and L21 and the audio transducers in the right headphone cup 2 are identified as R20 and R21. The connections of the cable 9 to the ambience control circuit 53 are made at a set of input terminals which include an input terminal 34 that receives the left back audio signal, an input terminal 35 that receives the left front audio signal, an input terminal 36 that receives the right front audio signal and an input terminal 37 that receives the right back audio signal. The input terminals 34-37 as well as signal ground terminals 38 and 39 connect through the cable 9 to the phone jacks 7 and 8.

Associated with the audio transducers L20, L21 R20 and R21 are double pole, double throw phase reversal switches 40, 41, 42 and 43. The leads from the primary audio transducer L20 connect to a first pair of terminals 44 on the phase reversal switch 40, and they connect with the opposite polarity to a second pair of terminals 45. One switch pole 46 connects through an isolation resistor 47 to the left front signal input terminal 35 and a second switch pole 48 connects to signal ground through an ambience resistor 49. The primary audio transducer L20 is thus connected in series with the resistors 47 and 49 to receive the left front audio signal, and by operating the switch 40, the phase of the applied audio signal can be reversed 180°.

The right primary audio transducer R20 is similarly connected to the phase reversal switch 42 which connects it in series with an isolation resistor 50 and an ambience resistor 51 to the right front audir signal applied to the input terminal 36. By operating the switch 42 the phase of the applied right front audio signal can be reversed 180°.

The leads on the left secondary audio transducer L21 connect to a first pair of terminals 52 on the phase reversal switch 41 and they connect with reverse polarity to a second pair of terminals 53. One pole 54 on the switch 41 connects through an isolation resistor 55 to receive the left back audio signal at the input terminal 34, and the other pole 56 connects to signal ground through a pair of series connected ambience resistors 57 and 58. The left secondary audio transducer is thus connected in series with the resistors 55, 57 and 58 to receive the left back audio signal. The right secondary audio transducer R21 is similarly connected to the phase reversal switch 43 and is thus connected in series with an isolation resistor 59 and a pair of ambience resistors 60 and 61 to receive the right back audio signal applied to the input terminal 37.

The ambience control circuit 33 includes a front channel ambience control subcircuit indicated by the dashed line 65 and a back channel ambience control subcircuit indicated by the dashed line 66. The front channel subcircuit operates to couple a phase shifted portion of the audio signal applied directly to each of the primary audio transducers L20 and R20 to the other primary audio transducer, whereas the back channel subcircuit 66 performs the same function with the secondary audio tranducers L21 and R21. More specifically, the front channel subcircuit includes a double pole, double throw ambience switch 67 which has a first pair of terminals 68 connected to signal ground and a second pair of terminals 69 connected to one lead on the respective ambience resistors 49 and 51. A left pole 70 on the switch 67 connects through a coupling resistor 71 to receive the right front audio signal at the input terminal 36 and a right pole 72 connects through a coupling resistor 73 to receive the left front audio signal at the input terminal 35. When in the position shown, the ambience switch 67 couples a portion of the right front audio signal from the input terminal 36 to the ungrounded lead on the ambience resistor 49 and it couples a portion of the left front audio signal appearing at the input terminal 35 to the ungrounded lead on the ambience resistor 51. The amount of cross coupling is determined by the relative values of the ambience resistors 49 and 51 with respect to the coupling resistors 73 and 71 as described in the above cited copending patent application. The cross coupled signals are effectively phase shifted 180° by their injection at the juncture of the transducers L20 and R20 and their associated ambience resistors 49 and 51. By manually operating the ambience switch 67 to its other position, the front channel ambience control subcircuit 65 is made inoperative and no cross coupling of front channel audio signals is obtained.

With one exception, the back channel ambience control subcircuit 66 operates in the same fashion as the front channel control subcircuit 65. The subcircuit 66 includes a double pole, double throw ambience switch 74 which has a first pair of terminals 75 that connect to the junctions of the respective ambience resistor pairs 57–58 and 60–61, and a second pair of terminals 76 which connect to the other leads on the respective ambience resistors 57 and 60. A left pole 77 on the ambience switch 74 connects through a coupling resistor 78 to receive the right back audio signal at the input terminal 37, and a right pole 79 connects through a coupling resistor 80 to receive the left back audio signal at the input terminal 34. Unlike the forward channel ambience control subcircuit 65, a certain amount of cross coupling is obtained with both positions of the ambience switch 74. However, as in the case of the subcircuit 65, the cross coupled signals are effectively phase shifted 180°.

The ambience control circuit 33 also includes means for summing the front and rear audio signals applied to the transducers L20–L21 and R20–R21. The summing circuit includes double pole, double throw summing switch 81 which has a pair of terminals 82 and 83 that connect to the respective isolation resistors 47 and 50. A first pole 84 on the summing switch 81 connects to the isolation resistor 55 and a second pole 85 connects to the isolation resistor 59. When the switch 81 is operated to connect the terminals 82 and 83 with the respective poles 84 and 85, the left front audio signal coupled through the isolation resistor 47 is combined with the left back audio signal coupled through the isolation resistor 55 and the combined signal is applied to both the primary and secondary audio transducers L20 and L21. Similarly, the right front and right back audio signals coupled through the isolation resistors 50 and 59 are combined and applied to both the primary and secondary audio transducers R20 and R21. The isolation resistors 55, 47, 50 and 59 decouple the summed front and back audio signals on each side from the four quadraphonic channels so that portions of each audio channel can be cross coupled by the ambience control subcircuits 65 and 66 when the summing switch 81 is closed.

The ambience control circuit 33 also includes a six-pole, double throw comparator switch 87 which provides a manually operable means for disconnecting the ambience control subcircuits 65 and 66 and the summing switch 81 to provide unmixed quadraphonic listening. The switch 87 includes a first pole 88 connected in series between the isolation resistor 47 and summing switch 81, a second pole 89 connected in series between the isolation resistor 50 and the summing switch 81, third and fourth poles 90 and 91 connected in series with the respective coupling resistors 73 and 71, and fifth and sixth poles 92 and 93 connected in series with the respective coupling resistors 80 and 78.

The ambience control circuit 33 provides one hundred and twenty-eight distinctive listening experiences. The switches which control the operation of the ambience control circuit are conveniently mounted within the ambience programmer 4 which is shaped to fit within the hand of the user and which may be placed in a shirt pocket when the desired mixing selection has been found.

It should be apparent that many variations can be made in the above described structure without departing from the spirit of the invention. The headphone structure described herein is of the velocity type which is light-weight, however, the invention may also be applied to pressure type headphones in which a seal is maintained between the cups and the listener's head. Also, further control over the cross coupling of phase shifted audio signals can be obtained by using potentimeters instead of fixed resistors for the ambience resistors.

We claim as our invention:

1. In a headphone for reproducing quadraphonic program material having a pair of cups connected together by a headband which retains the cups over the ears of a listener, the combination comprising:

a baffle in each of said cups which divides each cup into a front chamber which couples with the ear canal of the user and a rear chamber which is substantially enclosed by the cup;

a first primary audio transducer mounted to the baffle in one of said cups and positioned with its sound emitting axis directly over the listener's ear canal, said first primary audio transducer being electrically connected to receive one of the front channels of said quadraphonic program material;

a first secondary audio transducer mounted to the baffle in said one cup and positioned with its sound emitting axis displaced forward of the listener's ear a substantial distance, said first secondary audio transducer being electrically connected to receive one of the back channels of said quadraphonic program material;

a second primary audio transducer mounted to the baffle in the other of said cups and positioned with its sound emitting axis directly over the listener's ear canal, said second primary audio transducer being electrically connected to receive the other front channel of said quadraphonic program material;

a second secondary audio transducer mounted to the baffle in said other cup and positioned with its sound emitting axis displaced forward of the listener's ear a substantial distance, said second secondary audio transducer being electrically connected to receive the other back channel of said quadraphonic program material;

wherein the longer sound path from the secondary transducer in each cup to the listener's ear canal provides a time delay for the back channel program material; and in which an ambience programmer is electrically connected to receive the quadraphonic program material and is electrically connected to each of said audio transducers, said ambience programmer having a front ambience control circuit which includes:

first resistance means for coupling a portion of the front channel program material applied to the first primary audio transducer to the second primary audio transducer and imparting a substantial phase shift thereto; and second resistance means for coupling a portion of the front channel program material applied to the second primary audio transducer to the first primary audio transducer and imparting a substantial phase shift thereto.

2. The headphone as recited in claim 1 in which said ambience programmer has a back channel ambience control circuit which includes:

third resistance means for coupling a portion of the back channel program material applied to the first second audio transducer to the second secondary audio transducer and imparting a substantial phase shift thereto; and fourth resistance means for coupling a portion of the back channel program material applied to the second secondary audio transducer to the first secondary audio transducer and imparting a substantial phase shift thereto.

3. The headphone as recited in claim 2 in which each of said resistance means for coupling program material includes a manually operable switch electrically connected to control the coupling of said program material.

4. The headphone as recited in claim 3 in which said front and back ambience control circuits are mounted within a separate case having a front panel and said switches are positioned on said front panel for selective operation by the listener.

5. The headphone as recited in claim 2 in which said ambience programmer includes first summing means for coupling the front channel program material applied to the first primary audio transducer to the first secondary audio transducer and for coupling the back channel program material applied to the first secondary audio transducer to the first primary audio transducer, and second summing means for coupling the front channel program material applied to the second primary audio transducer to the second secondary audio transducer and for coupling the back channel program material applied to the second secondary audio transducer to the second primary audio transducer.

6. In a headphone for reproducing quadraphonic program material having a left primary and a left secondary audio transducer mounted in one cup and a right primary and a right secondary audio transducer mounted in another cup, the improvement therein of an ambience control circuit contained within a case which electrically connects to the audio transducers in said cups and is connectable to a source of quadraphonic program material, said ambience control circuit comprising:

means for coupling the left front and left back channels of said quadraphonic program material to one lead on the respective left primary and left secondary audio transducers;

means for coupling the right front and right back channels of said quadraphonic program material to one lead on the respective right primary and right secondary audio transducers;

a first ambience resistor connecting the other lead on the left primary audio transducer to signal ground;

a second ambience resistor connecting the other lead on the right primary audio transducer to signal ground;

a third ambience resistor connecting the other lead on said left secondary audio transducer to signal ground;

a fourth ambience resistor connecting the other lead on said right secondary audio transducer to signal ground;

a first coupling resistor connected to couple the right front channel of said quadraphonic program material to the junction of said first ambience resistor and said left primary audio transducer;

a second coupling resistor connected to couple the left front channel of said quadraphonic program material to the junction of said second ambience resistor and said right primary audio transducer;

a third coupling resistor connected to couple the right back channel of said quadraphonic program material to the junction of said third ambience resistor and said left secondary audio transducer; and a fourth coupling resistor connected to couple the left back channel of said quadraphonic program material to the junction of said fourth ambience resistor and said right secondary audio transducer.

7. The headphone as recited in claim 6 in which manually operable switch means are mounted to said case and electrically connected in series with each of said coupling resistors.

8. The headphone as recited in claim 6 in which each of said means for coupling a channel of said quadraphonic program material to a first lead on one of said audio transducers includes an isolation resistor and said ambience control circuit further includes manually operable summing switch means mounted to said case and electrically connected to each of said isolation resistors to electrically combined the left front and left back channels applied to said left primary and left secondary audio transducers and to combine the right front and right back channels applied to said right primary and right secondary audio transducers.

9. A headphone for reproducing quadraphonic program material, the combination comprising:

a headband suitable for extending over the top of a listener's head and defining a plane which includes the ears of the listener;

a left cup and a right cup connected to the respective ends of the headband to substantially cover the left and right ears of a listener;

a left primary audio transducer mounted within said left cup with its sound emitting axis substantially within the plane defined by the headband;

a right primary audio transducer mounted within said right cup with its sound emitting axis substantially within the plane defined by the headband;

a left secondary audio transducer mounted within said left cup with its sound emitting axis displaced a substantial distance to one side of the plane defined by the headband;

a right secondary audio transducer mounted within said right cup with its sound emitting axis displaced a substantial distance to said one side of the plane defined by the headband; and means electrically coupling the left front and right front channels of said quadraphonic program material to said respective left primary and right primary audio transducers and means electrically coupling the left back and right back channels of said quadraphonic program material to said respective left secondary and right secondary audio transducers.

10. The headphone as recited in claim 9 in which each cup includes a cushion which bears against the listener's head when the headphone is in place, each of said cushions being contoured to comfortably extend forward from the listener's ears substantially further than its rearward extension therefrom, and in which said secondary audio transducers are mounted within said cups forward of the plane defined by the headband.

11. The headphone as recited in claim 9 in which said cups are asymmetrical with respect to the headband to extend forward therefrom a substantially greater distance than their rearward extent, and in which said secondary audio transducers are mounted in the forwardly extending portions of their respective cups.

* * * * *